US007569321B2

(12) United States Patent
Mattison, Jr. et al.

(10) Patent No.: US 7,569,321 B2
(45) Date of Patent: Aug. 4, 2009

(54) TONER COMPOSITIONS

(75) Inventors: Dennis A. Mattison, Jr., Marion, NY (US); Vincenzo G. Marcello, Webster, NY (US); Steven A. VanScott, Fairport, NY (US); Nancy S. Hunt, Ontario, NY (US); Chieh-Min Cheng, Rochester, NY (US); Dawn M. Jacobs, Webster, NY (US)

(73) Assignee: Xerox Corporation, Stamford, CT (US)

( * ) Notice: Subject to any disclaimer, the term of this patent is extended or adjusted under 35 U.S.C. 154(b) by 412 days.

(21) Appl. No.: 11/517,598

(22) Filed: Sep. 7, 2006

(65) Prior Publication Data

US 2008/0063966 A1 Mar. 13, 2008

(51) Int. Cl.
*G03G 9/00* (2006.01)

(52) U.S. Cl. ..... 430/110.2; 430/108.6; 430/108.7; 430/108.8; 430/137.14

(58) Field of Classification Search ..... 430/110.2, 430/108.6, 108.7, 108.8, 137.14
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,674,736 | A | 7/1972 | Lerman et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,990 | A | 5/1981 | Stolka et al. |
| 4,394,430 | A | 7/1983 | Jadwin et al. |
| 4,560,635 | A | 12/1985 | Hoffend et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,190,815 | B1 | 2/2001 | Ciccarelli et al. |
| 6,562,535 | B1 * | 5/2003 | Masuo et al. ..... 430/108.22 |
| 6,878,499 | B2 | 4/2005 | Proper |
| 2007/0087281 | A1 * | 4/2007 | Patel et al. ..... 430/110.2 |

* cited by examiner

*Primary Examiner*—Mark A Chapman
(74) *Attorney, Agent, or Firm*—Carter, DeLuca, Farrell & Schmidt, LLP

(57) ABSTRACT

Single component toners having a core with a first latex having a specific glass transition temperature and molecular weight, further having a shell surrounding the core with a second latex having a specific glass transition temperature and molecular weight, and additives added thereto, and processes for producing the same. In embodiments, the toner is a non-magnetic single component toner produced by emulsion aggregation methods.

20 Claims, No Drawings

TONER COMPOSITIONS

BACKGROUND

The present disclosure relates generally to toners and toner processes, and more specifically, to toner compositions, in embodiments, possessing excellent charging properties and dispensing performance.

Numerous processes are known for the preparation of toners, such as, for example, conventional processes wherein a resin is melt kneaded or extruded with a pigment, micronized and pulverized to provide toner particles. In addition, there are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner may also be made by an emulsion aggregation process. Methods of preparing an emulsion aggregation (EA) type toner are known and toners may be formed by aggregating a colorant with a latex polymer formed by batch or semi-continuous emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared in (ii), and optionally a free radical initiator, from about 0 to about 99.5 percent by weight, or from about 0 to about 97 percent by weight, of the total initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems, which generally use only toner. Of the one-component development systems, both magnetic and non-magnetic systems are known. Magnetic systems involve the use of a toner containing a magnetic substance, which may preclude the development of sharp color images, which has led to a focus on non-magnetic systems.

The operating latitude of a powder xerographic development system may be determined to a great degree by the ease with which toner particles may be supplied to an electrostatic image. Placing charge on the particles, to enable movement and development of images via electric fields, is often accomplished with triboelectricity. Triboelectric charging may occur either by mixing the toner with larger carrier beads in a two component development system, or by rubbing the toner between a blade and donor roll in a single component system. However, non-magnetic single component development (SCD) toner requires high flowability and high chargeability, sometimes greater than that required for conventional two component development (TCD) toner.

With non-magnetic SCD, toner is supplied from a toner house to the supply roll and then to the development roll. The toner is charged while it passes a charging/metering blade. Non-magnetic SCD has been very popular for desk top color laser printers due to its compact size since it does not need carrier in the development housing to charge toner. Non-magnetic SCD systems may thus utilize cartridges that are smaller in size compared with TCD systems, and the cost to a customer to replace a unit may, in some cases, be lower for a single component development system compared with a two component system. The development area may require toner with high flowability to move to the photoreceptor. The toner should be robust throughout the life of the Customer Replaceable Unit (CRU) for the toner, which is typically about several thousand pages to a couple of tens of thousands of pages.

There are several problems with SCD. The first is low charge and broad charge distribution on toner particles compared with conventional TCD toner. This is because the time for toner to flow through the gap between the blade and the development roll is very short. Low charge causes high background and low developability. Toner for SCD also has a high fines content. The fines content in toner also affect the charge and the print background. The higher the fines content, the broader the charge distribution.

Another problem with SCD includes toner robustness in aging and in extreme environments such as A and C zone conditions. The high stress under the blade may cause the toner to stick to the blade or the development roll. This may reduce the toner charge and the toner flowability. Since non-magnetic toner is charged through a charging/metering blade, low charging and low flowability can cause print defects such as ghosting, white bands, and low toner density on images.

Hence, it would be advantageous to provide a toner composition with excellent charging characteristics and excellent dispensing performance.

SUMMARY

The present disclosure provides toner compositions which include a core of a first latex having a glass transition temperature from about 45° C. to about 54° C. and a molecular weight from about 33,000 to about 37,000, a shell surrounding said core comprising a second latex having a glass transition temperature from about 55° C. to about 65° C. and a molecular weight from about 33,000 to about 37,000, and at least two additives. In embodiments, the at least two additives may include silicas, metal oxides, colloidal silicas, strontium titanates, and combinations thereof. In embodiments, the toner may be a single component toner composition.

In other embodiments, the present disclosure provides a single component toner including a core of a first latex, a shell of a second latex, and at least two additives. The first latex used to form the core may include styrene acrylates, styrene butadienes, styrene methacrylates, and combinations thereof having a glass transition temperature from about 45° C. to about 54° C. and a molecular weight from about 33,000 to about 37,000. The second latex used to form the shell may include styrene acrylates, styrene butadienes, styrene methacrylates, and combinations thereof having a glass transition temperature from about 55° C. to about 65° C. and a molecular weight from about 33,000 to about 37,000. The at least two additives may include silicas, metal oxides, colloidal silicas, strontium titanates, and combinations thereof.

Processes for forming toners are also provided. In embodiments, the process may include contacting a latex having a glass transition temperature from about 45° C. to about 54° C. and a molecular weight from about 33,000 to about 37,000, with an aqueous colorant dispersion, and a wax dispersion having a melting point of from about 70° C. to about 85° C. to form a blend. The above blend may be mixed with a coagulant, the mixture may be heated to form an aggregated suspension, and a base may be added to increase the pH to a value of from about 4 to about 7. The aggregated suspension may then be heated to coalesce the aggregated suspension thereby forming a toner core. A second latex may be added to the aggregated suspension, wherein the second latex has a glass transition temperature from about 55° C. to about 65° C. and a molecular weight from about 33,000 to about 37,000, and forms a shell over said toner core. At least two additives may be added to the toner and the toner then recovered.

DETAILED DESCRIPTION

The present disclosure provides a toner suitable for use in a single component development system which possesses excellent flow characteristics and toner blocking temperatures. The excellent flow characteristics of the resulting toners reduce the incidence of clogging failure and print defects such as ghosting, white bands, and low toner density compared with conventionally produced toners. Toners of the present disclosure may be utilized to produce images having excellent gloss characteristics. Toners of the present disclosure may also have blocking temperatures that are higher compared with conventional toners.

Blocking temperature includes, in embodiments, for example, the temperature at which caking or agglomeration occurs for a given toner composition.

In embodiments, the toners may be an emulsion aggregation type toner prepared by the aggregation and fusion of latex resin particles and waxes with a colorant, and optionally one or more additives such as surfactants, coagulants, surface additives, and mixtures thereof. In embodiments, one or more may be from about one to about twenty, and in embodiments from about three to about ten.

In embodiments, the latex may have a glass transition temperature of from about 54° C. and about 65° C., and in embodiments, of from about 55° C. to 61° C. In embodiments, the latex may include submicron particles having a size of, for example, from about 50 to about 500 nanometers, in embodiments from about 100 to about 400 nanometers in volume average diameter as determined, for example, by a Brookhaven nanosize particle analyzer. The latex resin may be present in the toner composition in an amount from about 75 weight percent to about 98 weight percent, and in embodiments from about 80 weight percent to about 95 weight percent of the toner or the solids of the toner. The expression solids can refer, in embodiments, for example, to the latex, colorant, wax, and any other optional additives of the toner composition.

In embodiments of the present disclosure, the resin in the latex may be derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA) and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures thereof. In embodiments, the polymer is poly (styrene/butyl acrylate/beta carboxylethyl acrylate). The polymer may be block, random, or alternating copolymers.

In embodiments, the latex may be prepared by a batch or a semicontinuous polymerization resulting in submicron non-crosslinked resin particles suspended in an aqueous phase containing a surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments suitable anionic surfactants include NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments a suitable cationic surfactant includes SANISOL B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments a suitable nonionic surfactant is ANTAROX 897 available from Rhone-Poulenc Inc., which is primarily an alkyl phenol ethoxylate.

In embodiments, the resin of the latex may be prepared with initiators, such as water soluble initiators and organic soluble initiators. Exemplary water soluble initiators include ammonium and potassium persulfates which can be added in suitable amounts, such as from about 0.1 to about 8 weight percent, and in embodiments of from about 0.2 to about 5 weight percent of the monomer. Examples of organic soluble initiators include Vazo peroxides, such as VAZO 64™, 2-methyl 2-2'-azobis propanenitrile, VAZO 88™, 2-2'-azobis isobutyramide dehydrate, and mixtures thereof. Initiators can be added in suitable amounts, such as from about 0.1 to about 8 weight percent, and in embodiments of from about 0.2 to about 5 weight percent of the monomers.

Known chain transfer agents can also be utilized to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, and in embodiments of from about 0.2 to about 10 percent by weight of the monomer.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other processes within the purview of those skilled in the art.

In embodiments, the resin of the latex may be non-crosslinked; in other embodiments, the resin of the latex may be a crosslinked polymer; in yet other embodiments, the resin may be a combination of a non-crosslinked and a crosslinked polymer. Where crosslinked, a crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, and in embodiments of from about 0.5 to about 15 percent by weight of the crosslinked resin.

Where present, crosslinked resin particles may be present in an amount of from about 0.1 to about 50 percent by weight, and in embodiments of from about 1 to about 20 percent by weight of the toner.

The latex may then be added to a colorant dispersion. The colorant dispersion may include, for example, submicron colorant particles having a size of, for example, from about 50 to about 500 nanometers, and in embodiments of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and from about 1 to about 25 percent by weight, in embodiments from about 4 to about 15 percent by weight of the colorant.

Colorants include pigments, dyes, mixtures of pigments and dyes, mixtures of pigments, mixtures of dyes, and the like. The colorant may be, for example, carbon black, cyan, yellow, magenta, red, orange, brown, green, blue, violet or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example, from about 0.5 to about 20 percent by weight of the toner, in embodiments from about 3 to about 12 percent by weight of the toner.

The toner compositions of the present disclosure may further include a wax with a melting point of from about 70° C. to about 85° C., and in embodiments of from about 75° C. to about 81° C. The wax enables toner cohesion and prevents the formation of toner aggregates. In embodiments, the wax may be in a dispersion. Wax dispersions suitable for use in forming toners of the present disclosure include, for example, submicron wax particles having a size of from about 50 to about 500 nanometers, in embodiments of from about 100 to about 400 nanometers in volume average diameter. The wax particles may be suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include any suitable wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, polypropylene wax, and mixtures thereof. In embodiments, the wax may be a modified wax such as a montan wax derivative, paraffin wax derivative, and/or microcrystalline wax derivative, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasel K.K., and similar materials. In embodiments, suitable commercially available polyethylene waxes possess a molecular weight (Mw) of from about 1,000 to about 1,500, and in embodiments of from about 1,250 to about 1,400, while suitable commercially available polypropylene waxes may possess a molecular weight of from about 4,000 to about 5,000, and in embodiments of from about 4,250 to about 4,750.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, in embodiments from about 2 to about 20 percent by weight of the toner. In some embodiments, where a polyethylene wax is used, the wax may be present in an amount of from about 8 to about 14 percent by weight, in embodiments from about 10 to about 12 percent by weight of the toner.

The resultant blend of latex dispersion, colorant dispersion, and wax dispersion may be stirred and heated to a temperature less then the glass transition temperature of the latex, in embodiments from about 45° C. to about 65° C., in embodiments of from about 48° C. to about 63° C., resulting in toner aggregates of from about 4 microns to about 8 microns in volume average diameter, and in embodiments of from about 5 microns to about 7 microns in volume average diameter.

In embodiments, a coagulant may be added during or prior to aggregating the latex, the aqueous colorant dispersion, and the wax dispersion. The coagulant may be added over a period of time from about 1 to about 5 minutes, in embodiments from about 1.25 to about 3 minutes.

Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to be of the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.02 to about 0.3 percent by weight of the toner, and in embodiments from about 0.05 to about 0.2 percent by weight of the toner.

Optionally a second latex can be added to the aggregated particles. The second latex may include, for example, submicron non-crosslinked resin particles. Any resin described above as suitable for the latex may be utilized as the core or shell. The second latex may be added in an amount of from about 10 to about 40 percent by weight of the initial latex, in embodiments of from about 15 to about 30 percent by weight of the initial latex, to form a shell or coating on the toner aggregates. The thickness of the shell or coating may be from about 200 to about 800 nanometers, and in embodiments from about 250 to about 750 nanometers. In embodiments, the latex utilized for the core and shell may be the same resin; in other embodiments, the latex utilized for the core and shell may be different resins.

In embodiments, the second latex may have a molecular weight comparable to the molecular weight of the first latex. Thus, the first latex could have molecular weights from about 33,000 to about 37,000, in embodiments from about 34,000 to about 36,000, and the second resin could have molecular weights from about 33,000 to about 37,000, in embodiments from about 34,000 to about 36,000.

In addition, in embodiments the latex utilized to form the shell may have a glass transition temperature (Tg) greater than the glass transition temperature of the latex utilized to form the core. In embodiments, the Tg of the shell latex may be from about 55° C. to about 65° C., in embodiments from about 57° C. to about 61° C., while the Tg of the core latex may be from about 45° C. to about 54° C., in embodiments from about 49° C. to about 53° C. In some embodiments, the latex may be a styrene/butyl acrylate copolymer. As noted above, in embodiments the Tg of the latex utilized to form the core may be lower than the Tg of the latex utilized to form the shell. For example, in embodiments, a styrene/butyl acrylate copolymer having a Tg from about 45° C. to about 54° C., in embodiments from about 49° C. to about 53° C., may be utilized to form the core, while a styrene/butyl acrylate copolymer having a Tg from about 55° C. to about 65° C., in embodiments from about 57° C. to about 61° C. may be utilized to form the shell.

Similarly, while the latexes utilized to form the core and shell may be the same, the amounts of the various monomers may vary. Thus, in embodiments, the resin for the core of a toner particle may include a styrene/butyl acrylate copolymer having from about 70% by weight to about 78% by weight styrene, and from about 22% by weight to about 30% by weight butyl acrylate, in embodiments from about 74% by weight to about 77% by weight styrene, and from about 21% to about 25% by weight butyl acrylate. At the same time, a styrene/butyl acrylate copolymer utilized to form the shell of a toner particle may include a styrene/butyl acrylate copolymer having from about 79% by weight to about 85% by weight styrene, and from about 15% by weight to about 21% by weight butyl acrylate, in embodiments from about 81% by weight to about 83% by weight styrene, and from about 17% to about 19% by weight butyl acrylate.

Once the desired final size of the particles is achieved with a volume average diameter of from about 4 microns to about 9 microns, and in embodiments of from about 5.6 microns to about 8 microns, the pH of the mixture may be adjusted with a base to a value of from about 4 to about 7, and in embodiments from about 6 to about 6.8. Any suitable base may be used such as, for example, alkali metal hydroxides such as, for example, sodium hydroxide, potassium hydroxide, and ammonium hydroxide. The alkali metal hydroxide may be added in amounts from about 6 to about 25 percent by weight of the mixture, in embodiments from about 10 to about 20 percent by weight of the mixture.

The mixture is then heated above the glass transition temperature of the latex utilized to form the core and the latex utilized to form the shell. The temperature the mixture is heated to will depend upon the resin utilized but may, in embodiments, be from about 48° C. to about 98° C., in embodiments from about 55° C. to about 95° C. Heating may occur for a period of time from about 20 minutes to about 3.5 hours, in embodiments from about 1.5 hours to about 2.5 hours.

The pH of the mixture is then lowered to from about 3.5 to about 6 and, in embodiments, to from about 3.7 to about 5.5 with, for example, an acid to coalesce the toner aggregates and modify the shape. Suitable acids include, for example, nitric acid, sulfuric acid, hydrochloric acid, citric acid and/or acetic acid. The amount of acid added may be from about 4 to about 30 percent by weight of the mixture, and in embodiments from about 5 to about 15 percent by weight of the mixture.

The mixture is subsequently coalesced. Coalescing may include stirring and heating at a temperature of from about 90° C. to about 99° C., for a period of from about 0.5 to about 6 hours, and in embodiments from about 2 to about 5 hours. Coalescing may be accelerated by additional stirring during this period of time.

The mixture is cooled, washed and dried. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

The washing may be carried out at a pH of from about 7 to about 12, and in embodiments at a pH of from about 9 to about 11. The washing may be at a temperature of from about 45° C. to about 70° C., and in embodiments from about 50° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying is typically carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

An emulsion aggregation toner of the present disclosure may have particles with a circularity of from about 0.93 to about 0.99, and in embodiments of from about 0.96 to about 0.985. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period. This results in excellent transfer of the toner, less waste of toner, and thus lower cost per print for a customer utilizing such toner.

The toner of the present disclosure may possess surface areas from about 1 $m^2/g$ to about 2.5 $m^2/g$, in embodiments from about 1.25 $m^2/g$ to about 2 $m^2/g$, as determined by the Brunauer, Emmett and Teller (BET) method. The spherical particle shape and smooth (low) surface area of the non-magnetic toner particles of the present disclosure permits the uniform distribution of surface additives on the toner surface, which results in excellent flowability and chargeability control and optimization.

The melt flow index (MFI) of toners produced in accordance with the present disclosure may be determined by methods within the purview of those skilled in the art, including the use of a plastometer. For example, the MFI of the toner may be measured on a Tinius Olsen extrusion plastometer at about 125° C. with about 5 kilograms load force. Samples may then be dispensed into the heated barrel of the melt indexer, equilibrated for an appropriate time, in embodiments from about five minutes to about seven minutes, and then the load force of about 5 kg may be applied to the melt indexer's piston. The applied load on the piston forces the molten sample out a predetermined orifice opening. The time for the test may be determined when the piston traveled one inch. The melt flow may be calculated by the use of the time, distance, and weight volume extracted during the testing procedure.

MFI as used herein thus includes, in embodiments, for example, the weight of a toner (in grams) which passes through an orifice of length L and diameter D in a 10 minute period with a specified applied load (as noted above, 5 kg). An MFI unit of 1 thus indicates that only 1 gram of the toner passed through the orifice under the specified conditions in 10 minutes time. "MFI units" as used herein thus refers to units of grams per 10 minutes.

Toners of the present disclosure subjected to this procedure may have varying MFI depending on the pigment utilized to form the toner. In embodiments, a black toner of the present disclosure may have an MFI from about 30 gm/10 min to about 50 gm/10 min, in embodiments from about 36 gm/10 min to about 47 gm/10 min; a cyan toner may have an MFI from about 30 gm/10 min to about 50 gm/10 min, in embodiments from about 36 gm/10 min to about 46 gm/10 min; a yellow toner may have an MFI from about 12 gm/10 min to about 50 gm/10 min, in embodiments from about 16 gm/10 min to about 35 gm/10 min; and a magenta toner may have an MFI of from about 45 gm/10 min to about 55 gm/10 min, in embodiments from about 48 gm/10 min to about 52 gm/10 min.

In an electrophotographic apparatus, the lowest temperature at which toner adheres to the fuser roll is called the cold offset temperature; the maximum temperature at which the toner does not adhere to the fuser roll is called the hot offset temperature. When the fuser temperature exceeds the hot offset temperature, some of the molten toner adheres to the fuser roll during fixing, is transferred to subsequent substrates (phenomenon known as "offsetting"), and results for example in blurred images. Between the cold and hot offset temperatures of the toner is the minimum fix temperature, which is the minimum temperature at which acceptable adhesion of the toner to the support medium occurs. The difference between minimum fix temperature and hot offset temperature is called the fusing latitude. As will be recognized by one skilled in the art, the rheology of toners, especially at high temperatures, may be affected by the length of the polymer chain utilized to form the binder resin as well as any crosslinking or the formation of a polymer network in the binder resin.

Toners of the present disclosure may possess cold offset temperatures higher than about 130° C., in embodiments from about 130° C. to about 140°, in embodiments from about 134° C. to about 137°, and hot offset temperatures higher than about 180° C., in embodiments from about 190° C. to about 210°, in embodiments from about 195° C. to about 205°. The minimum fix temperature for toners of the present disclosure may be from about 135° C. to about 170° C., in embodiments from about 140° C. to about 160° C. Toners of the present disclosure, with resins possessing differing molecular weights in the core and shell, can provide excellent fusing latitude.

The particle size of a non-magnetic SCD toner of the present disclosure may be from about 4 microns to about 8 microns, in embodiments from about 5 microns to about 7 microns in volume average diameter. The geometric mean particle diameter (GSD) of a toner of the present disclosure may be from about 1.1 to about 1.3, in embodiments from about 1.15 to about 1.25, as determined by a Layson Cell particle analyzer.

Non-magnetic single component development toners of the present disclosure may possess a dynamic viscosity of from about $10^2$ poise to about $10^6$ poise, in embodiments from about $10^3$ poise to about $10^5$ poise. In addition, a non-magnetic SCD of the present disclosure may have an elastic modulus of from about $10^3$ dyne/cm$^2$ to about $10^6$ dyne/cm$^2$, in embodiments from about $10^4$ dyne/cm$^2$ to about $10^5$ dyne/cm$^2$, as measured at 10 rad/second at 120° C.

The toners of the present disclosure may be produced economically utilizing a simple manufacturing process. Use of a latex resin having a high Tg as the shell will result in a higher blocking temperature, in embodiments about 5° C. higher, compared with other conventional toners. This higher blocking temperature improves the stability of the toners during transportation and storage, especially in warmer climates. While a conventional toner may have a blocking temperature of from about 48° C. to about 51° C., the blocking temperature of a toner of the present disclosure may be from about 51° C. to about 58° C., in embodiments from about 53° C. to about 56° C.

The toner may also include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

As noted above, in embodiments, the toner of the present invention may be used as the toner component of various developers, including non-magnetic single component developers. Surface additives can be added to the toner compositions of the present disclosure after washing or drying. Surface additives can play an important role in non-magnetic SCD. As toner particles are compressed and sheared between the nip of the charging/metering blade and the development roll, toner particles start to lose their developability. Thus, it is important to maintain the chargeability and flowability of toner throughout the CRU life.

When utilized as a non-magnetic single component developer, various external additives can be added thereto. Examples of such surface additives include, for example, metal salts, metal salts of fatty acids, colloidal silicas, metal oxides including titanium oxides, titanium dioxides, cerium oxides, strontium titanates, mixtures thereof, and the like. Surface additives may be present in an amount of from about 0.1 to about 10 weight percent, and in embodiments of from about 0.5 to about 7 weight percent of the toner. Examples of additional such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

In embodiments, combinations of additives, including combinations of silicas, may be utilized. To achieve this, it may be desirable to have at least 2 different surface additives.

In embodiments, at least two may be from about two to about twenty and, in embodiments, from about three to about ten. Such combinations include, for example, silicas and metal oxides such as titanium oxide and cerium oxide, colloidal silicas, strontium titanates, combinations thereof, and the like. In embodiments, suitable silicas which may be utilized include combinations of fumed silicas and sol-gel silicas.

In embodiments, the size of the additives utilized may vary. Thus, in embodiments, a first additive may have a surface area from about 25 nm to about 200 nm, in embodiments from about 40 nm to about 150 nm, while a second surface additive may have a surface area from about 1 nm to about 20 nm, in embodiments from about 2 nm to about 15 nm. In such an embodiment, the first additive may be present in an amount from about 2% to about 5% by weight of the toner, in embodiments from about 3% to about 4% by weight of the toner, while the second additive may be present in an amount from about 0.2% to about 2.5% by weight of the toner, in embodiments from about 1% to about 2% by weight of the toner, so that the total amount of additive may be from about 2.2% to about 7.5% by weight of the toner, in embodiments from about 4% to about 6% by weight of the toner. In embodiments, the first additive may include a silica and the second additive may include a metal oxide.

The above surface additives may be utilized to optimize charging and charge distribution of a toner. For example, the large surface additives may act as a spacer to prevent toner sticking to the development roll, thereby reducing the incidence of print defects such as ghosting, white bands, and low toner density on images.

Additives may be added to toners of the present disclosure utilizing any method within the purview of those skilled in the art, including blending, mixing, and the like. In embodiments, the blending of such additives and toner particles may impart triboelectric charges to the toner. Toners of the present disclosure may thus have a triboelectric charge at from about 35 μC/g to about 75 μC/g, in embodiments from about 44 μC/g to about 61 μC/g.

The additive attachment, sometimes referred to herein as "Additive Adhesion Force Distribution" ("AAFD") value. The AAFD value is a measure of how well a surface additive sticks to a toner particle even after being blasted with intense sonic energy. Methods for determining AAFD are within the purview of those skilled in the art and include, in embodiments, for example, the methods disclosed in U.S. Pat. No. 6,878,499, the disclosure of which is hereby incorporated by reference in its entirety. In embodiments, toners of the present disclosure may have an AAFD from about 25% to about 65% Si remaining after the application of about 3 K Joules, in embodiments from about 30% to about 55% Si remaining after the application of about 3 K Joules, and from about 0 to about 19% Si remaining after the application of about 12 K Joules, in embodiments from about 0.5% to about 16.5% Si remaining after the application of about 12 K Joules.

Another property of the toners of the present invention is the excellent cohesivity of the particles. The greater the cohesivity, the less the toner particles are able to flow. Cohesivity may be determined utilizing methods within the purview of those skilled in the art, in embodiments by placing a known mass of toner, for example two grams, on top of a set of about three screens, for example with screen meshes of about 53 microns, about 45 microns, and about 38 microns, in order from top to bottom, and vibrating the screens and toner for a fixed time at a fixed vibration amplitude, for example for about 115 seconds at about a 1 millimeter vibration amplitude. A device which may be utilized to perform this measurement includes the Hosokawa Powders Tester, commercially available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lower the flowability of the toner.

Toners of the present disclosure may have a cohesivity as determined above utilizing a Hosokawa Powder Tester, for example, from about 7.5% to about 45%, in embodiments from about 11% to about 35% for all colors utilizing toner of the present disclosure.

Toners of the present disclosure may also have a narrow distribution in particle size, which is desirable for use in image forming devices. When the distribution of particle size is wide, the ratio of toner having a small particle size relative to toner having a large particle size, or vice versa, may be increased. This may cause certain problems, for example, deterioration in the ability of the toner to retain a charge where there are a large number of small particles. In contrast, in the case of toner wherein there is a greater amount of large particles, there are problems such as a tendency for image quality deterioration because of inefficiency in the transfer of toner onto a recording media. Toners of the present disclosure may possess a narrow particle size distribution of from about 1 to about 1.5, in embodiments from about 1.15 to about 1.25.

The toners of the present disclosure have several advantages over conventional toners due to their spherical shape and the ability to control the size of the toner particles. The spherical shape of the toner particles results in particles having less contact area; therefore, the flowability of the toner is excellent. Smaller size toner particles that parallel the smaller pixels on the image screen can provide sharper images resulting in excellent resolution and print quality. Smaller size can also reduce image thickness leading to lower toner usage and less energy needed to fuse toner to the paper. The morphology of the toner of the present disclosure may also be adjusted so that fewer pigment particles are present on the toner surface. In addition, the amount of fines in the resulting toner may be reduced.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

Images produced with such toners may thus have desirable gloss properties. Methods for determining gloss are within the purview of those skilled in the art and include, for example, the use of a Gardner Gloss Meter, which provides gloss measurements in Gardiner Gloss Units (ggu). For example, in embodiments, a Gardiner Gloss Meter may be utilized to determine gloss using a 75° angle at a toner mass per area (TMA) of about 1.05, and at a temperature of about 160° C. Toners of the present disclosure may possess a gloss of from about 20 ggu to about 120 ggu, in embodiments from about 40 ggu to about 80 ggu.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by a magnetic brush development process as disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A toner of the present disclosure was prepared by emulsion aggregation methods. Briefly, the toner was prepared as follows. About 3000 kg of a styrene/butyl acrylate resin, about 800 kg of PR238/122, a magenta colorant from Sun Chemical, about 7000 kg of de-ionized water, and about 50 kg of polyaluminum chloride as a flocculent were homogenized and mixed in a reactor for a period of time from about 1 hour to about 2.5 hours. The batch was then heated, while continually being mixed, from about 25° C. to about 47° C. (below the Tg of the resin), allowing for the particle aggregate mixture to grow. Once the aggregate achieved a particle size of about 4.2 microns to about 4.8 microns, about 1800 kg of a styrene/butyl acrylate resin was added as a shell, where the particle aggregate continued to grow until the desired particle size of about 5.2 microns to about 5.8 microns was achieved. Once the desired particle size was achieved, about 100 kg of caustic soda with about 60 kg of Versene (ethylenediamine tetraacetate (EDTA) from Dow Chemical) was added to the reaction, and the temperature was then raised from about 47° C. to about 95° C., where the shape of the particle began to spherodize above the Tg of the resin. Once the batch reached the coalescence temperature of about 95° C., the batch was held at that temperature for a period of time from about 2 hours to about 4 hours until the toner targeted circularity of from about 0.96 to about 0.985 was achieved as determined by Malvern's Sysmex FPIA-2100 Flow Particle Image Analyzer. The batch was then cooled to a temperature of about 40° C., whereupon about 300 kg to about 400 kg of acid was added in order to desorb the grafted surfactant molecules on the particle surface. Once cooled, the mixture was then transferred and screened through vibratory sieves, removing coarse particles. Once screened, the slurry was then washed and dried using a filter press followed by centrifugal drying.

The resulting toner possessed a styrene/butyl acrylate copolymer core of about 76.5 weight percent styrene and about 23.5 weight percent butyl acrylate, having a Tg of from about 49° C. to about 53° C. The resulting toner also possessed a styrene/butyl acrylate copolymer shell of about 81.7 weight percent styrene and about 18.3 weight percent butyl acrylate, having a Tg of from about 57° C. to about 61° C. The size of the resulting core/shell particles was from about 190 nm to about 220 nm and the molecular weight of the core/shell particles was from about 33 kpse to about 37 kpse.

A polyethylene wax (LX-1508 polyethylene wax from Baker Petrolite) was incorporated into the resulting latex resin. The wax/resin weight ratio was from about 0/100 to about 25/75. The wax possessed a melt temperature from about 70° C. to about 110° C. The resulting particle possessed an optimal surface wax protrusion with a surface wax content of from about 5 wt % to about 10 wt %. Controlling the surface wax content was important since the surface wax could influence toner flow properties.

The resulting magenta toner was blended with about 1.48% X24 (Large Silica), about 1.37% RY50 (Small Silica), about 0.88% JMT2000 (Titanium), about 0.7% CeO2 and about 0.3% UAdd (wax) additive (from Baker-Petrolite). The resulting toner particles possessed a total content of surface additives from about 4% to about 5% by weight.

The cohesion of the additives to the toner particles was determined using a Hosokawa Powder Tester, commercially available from Micron Powders Systems; the triboelectric charge of the particles was determined using a Xerox Barbetta Box, and the additive attachment (MFD) was determined using the methods of U.S. Pat. No. 6,878,499, the disclosure of which is hereby incorporated by reference in its entirety.

The cohesion of such toner was about 13.55% as determined using a Hosokawa powder tester. The toner particles possessed triboelectric charges of about 54.31 μC/g. Additive attachment (MFD) was about 45.2% Si remaining using 3 K Joules, and about 16.3% Si remaining using 12 K Joules.

The properties of this magenta toner of the present disclosure were tested by utilizing the toner in a single component development xerographic machine. Commercially available toners from Xerox Corporation were utilized as a control The average mass for the toner of the present disclosure was about 0.42 mg/cm$^2$, which was in the range of the control materials tested. (The range seen for the control toners was from about 0.34 to about 0.72 mg/cm$^2$.) Streaks were noted after about 3 hours, which was equivalent to or better than most of the control materials tested. While the control toners exhibited filming, the magenta toner of the present disclosure did not exhibit filming during the test.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A single component developer comprising an emulsion aggregation toner comprising:

a core comprising a first latex having a glass transition temperature from about 45° C. to about 54° C. and a molecular weight from about 33,000 to about 37,000;

a shell surrounding said core comprising a second latex having a glass transition temperature from about 55° C. to about 65° C. and a molecular weight from about 33,000 to about 37,000; and at least two additives, wherein the toner possesses a gloss of from about 20 ggu to about 120 ggu.

2. The single component developer according to claim 1, wherein the first latex has a glass transition temperature from about 49° C. to about 53° C. and a molecular weight from about 34,000 to about 36,000, and the latex in the shell has a glass transition temperature from about 56° C. to about 61° C. and a molecular weight from about 34,000 to about 36,000.

3. The single component developer according to claim 1, wherein the first latex is selected from the group consisting of styrene acrylates, styrene butadienes, styrene methacrylates, and combinations thereof, the latex in the shell is selected from the group consisting of styrene acrylates, styrene butadienes, styrene methacrylates, and combinations thereof, and the at least two additives are selected from the group consisting of silicas, metal oxides, colloidal silicas, strontium titanates, and combinations thereof.

4. The single component developer according to claim 1, wherein the at least two additives include a first additive comprising a silica having a surface area from about 25 nm to about 200 nm present in an amount from about 2% to about 5% by weight of the toner, and a second surface additive comprising a metal oxide having a surface area from about 1 nm to about 20 nm present in an amount from about 0.2% to about 2.5% by weight of the toner.

5. The single component developer according to claim 1, wherein the at least two additives include a first additive comprising a silica having a surface area from about 40 nm to about 150 nm present in an amount from about 3% to about 4% by weight of the toner, and a second surface additive comprising a metal oxide having a surface area from about 2 nm to about 15 nm present in an amount from about 1% to about 2% by weight of the toner.

6. The single component developer according to claim 1, wherein the toner comprises a non-magnetic emulsion aggregation toner and further comprises a colorant, and optionally one or more components selected from the group consisting of surfactants, coagulants, and optionally mixtures thereof.

7. The single component developer of claim 1, wherein the first latex comprises a styrene/butyl acrylate copolymer comprising from about 70% by weight to about 78% by weight styrene and from about 22% by weight to about 30% by weight butyl acrylate, and the second latex comprises a styrene/butyl acrylate copolymer comprising from about 79% by weight to about 85% by weight styrene and from about 15% by weight to about 21% by weight butyl acrylate.

8. The single component developer of claim 1, wherein the first latex comprises a styrene/butyl acrylate copolymer comprising from about 74% by weight to about 77% by weight styrene and from about 21% to about 25% by weight butyl acrylate, and the second latex comprises a styrene/butyl acrylate copolymer comprising from about 81% by weight to about 83% by weight styrene, and from about 17% to about 19% by weight butyl acrylate.

9. The single component toner developer of claim 1, wherein the toner possesses a triboelectric value of from about 35 μC/g to about 75 μC/g, a circularity from about 0.93 to about 0.99, a surface area from about 1 m$^2$/g to about 2.5 m$^2$/g, and a particle size distribution from about 1 to about 1.5.

10. The single component developer according to claim 1, wherein the toner possesses a triboelectric value of from about 44 μC/g to about 61 μC/g, a circularity from about 0.96 to about 0.985, a surface area from about 1.25 m$^2$/g to about 2 m$^2$/g, and a particle size distribution from about 1.15 to about 1.25.

11. A single component developer comprising an emulsion aggregation toner comprising:

a core comprising a first latex selected from the group consisting of styrene acrylates, styrene butadienes, styrene methacrylates, and combinations thereof having a glass transition temperature from about 45° C. to about 54° C. and a molecular weight from about 33,000 to about 37,000;

a shell surrounding said core comprising a second latex selected from the group consisting of styrene acrylates, styrene butadienes, styrene methacrylates, and combinations thereof having a glass transition temperature from about 55° C. to about 65° C. and a molecular weight from about 33,000 to about 37,000; and at least two additives selected from the group consisting of silicas, metal oxides, colloidal silicas, strontium titanates, and combinations thereof, wherein the toner possesses a gloss of from about 20 ggu to about 120 ggu.

12. The single component developer according to claim 11, wherein the first latex has a glass transition temperature from about 49° C. to about 53° C. and a molecular weight from about 34,000 to about 36,000, the latex in the shell has a glass transition temperature from about 56° C. to about 61° C. and a molecular weight from about 34,000 to about 36,000, and the at least two additives include a first additive comprising a silica having a surface area from about 25 nm to about 200 nm present in an amount from about 2% to about 5% by weight of the toner, and a second surface additive comprising a metal oxide having a surface area from about 1 nm to about 20 nm present in an amount from about 0.2% to about 2.5% by weight of the toner.

13. The single component developer according to claim 11, wherein the toner comprises an emulsion aggregation toner and further comprises a colorant, and optionally one or more components selected from the group consisting of surfactants, coagulants, and optionally mixtures thereof, and the at least two additives include a first additive comprising a silica having a surface area from about 40 nm to about 150 nm present in an amount from about 3% to about 4% by weight of the toner, and a second surface additive having a surface area from about 2 nm to about 15 nm present in an amount from about 1% to about 2% by weight of the toner.

14. The single component developer according to claim 11, wherein the first latex comprises a styrene/butyl acrylate copolymer comprising from about 70% by weight to about 78% by weight styrene and from about 22% by weight to about 30% by weight butyl acrylate, the second latex comprises a styrene/butyl acrylate copolymer comprising from about 79% by weight to about 85% by weight styrene and from about 15% by weight to about 21% by weight butyl acrylate, and the toner possesses a triboelectric value of from about 35 μC/g to about 75 μC/g, a circularity from about 0.93 to about 0.99, a surface area from about 1 $m^2/g$ to about 2.5 $m^2/g$, and a particle size distribution from about 1 to about 1.5.

15. A process comprising:

contacting a latex having a glass transition temperature from about 45° C. to about 54° C. and a molecular weight from about 33,000 to about 37,000, an aqueous colorant dispersion, and a wax dispersion having a melting point of from about 70° C. to about 85° C. to form a blend;

mixing the above blend with a coagulant;

heating the mixture to form an aggregated suspension;

adding a base to increase the pH to a value of from about 4 to about 7;

heating the aggregated suspension to coalesce the aggregated suspension thereby forming a toner core;

adding a second latex having a glass transition temperature from about 55° C. to about 65° C. and a molecular weight from about 33,000 to about 37,000 to the aggregated suspension, wherein the second latex forms a shell over said toner core;

adding at least two additives to said toner; and recovering said toner wherein the toner possesses a gloss of from about 20 ggu to about 120 ggu.

16. The process of claim 15, wherein the first latex is selected from the group consisting of styrene acrylates, styrene butadienes, styrene methacrylates, and combinations thereof having a glass transition temperature from about 49° C. to about 53° C. and a molecular weight from about 34,000 to about 36,000, the second latex is selected from the group consisting of styrene acrylates, styrene butadienes, styrene methacrylates, and combinations thereof having a glass transition temperature from about 56° C. to about 61° C. and a molecular weight from about 34,000 to about 36,000, the wax has a melting point of from about 75° C. to about 81° C., and the coagulant comprises a polyaluminum chloride or a polymetal silicate.

17. The process according to claim 15, wherein the at least two additives are selected from the group consisting of silicas, metal oxides, colloidal silicas, strontium titanates, and combinations thereof, and wherein the at least two additives include a first additive having a surface area from about 25 nm to about 200 nm present in an amount from about 2% to about 5% by weight of the toner, and a second surface additive having a surface area from about 1 nm to about 20 nm present in an amount from about 0.2% to about 2.5% by weight of the toner.

18. The process according to claim 15, wherein the at least two additives include a first additive comprising a silica having a surface area from about 40 nm to about 150 nm present in an amount from about 3% to about 4% by weight of the toner, and a second surface additive having a surface area from about 2 nm to about 15 nm present in an amount from about 1% to about 2% by weight of the toner.

19. The process according to claim 15, wherein the first latex comprises a styrene/butyl acrylate copolymer comprising from about 70% by weight to about 78% by weight styrene and from about 22% by weight to about 30% by weight butyl acrylate, and the second latex comprises a styrene/butyl acrylate copolymer comprising from about 79% by weight to about 85% by weight styrene and from about 15% by weight to about 21% by weight butyl acrylate.

20. A single component toner produced by the process of claim 15, wherein the toner possesses a triboelectric value of from about 35 μC/g to about 75 μC/g, a circularity from about 0.93 to about 0.99, a surface area from about 1 $m^2/g$ to about 2.5 $m^2/g$, and a particle size distribution from about 1 to about 1.5.

* * * * *